US008416180B2

(12) United States Patent
Huang

(10) Patent No.: US 8,416,180 B2
(45) Date of Patent: Apr. 9, 2013

(54) BACKLIGHT MODULATION CIRCUIT AND METHOD THEREOF

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Chu-Nan, Miao-Li County (TW)

( * ) Notice: Subject to any disclaimer, the term of this patent is extended or adjusted under 35 U.S.C. 154(b) by 1325 days.

(21) Appl. No.: 12/214,946

(22) Filed: Jun. 23, 2008

(65) Prior Publication Data

US 2008/0315796 A1 Dec. 25, 2008

(30) Foreign Application Priority Data

Jun. 22, 2007 (CN) ..... 2007 1 0075200

(51) Int. Cl.
*G09G 3/36* (2006.01)

(52) U.S. Cl.
USPC ..... 345/102; 345/87

(58) Field of Classification Search ..... 345/102, 345/87
See application file for complete search history.

(56) References Cited

U.S. PATENT DOCUMENTS 5,844,540 A 12/1998 Terasaki
2005/0057484 A1 3/2005 Diefenbaugh et al.
2005/0243052 A1* 11/2005 Lim ..... 345/102

FOREIGN PATENT DOCUMENTS

CN 1384415 A 12/2002
CN 1607884 A 4/2005

* cited by examiner

*Primary Examiner* — William Boddie
*Assistant Examiner* — Saifeldin Elnafia
(74) *Attorney, Agent, or Firm* — Muncy, Geissler, Olds & Lowe, PLLC

(57) ABSTRACT

A backlight modulation circuit includes an illumination controlling signal generating circuit, an illumination control signal separating circuit, and an illumination modulation circuit. The illumination controlling signal generating circuit is configured for receiving an modulation signal and generating an illumination controlling signal according to the modulation signal. The illumination control signal separating circuit is configured for separating the illumination controlling signal into a first modulation signal and a second modulation signal. The illumination modulation circuit is configured for modulating illumination of a backlight module according to the first and second modulation signals.

17 Claims, 6 Drawing Sheets

BACKLIGHT MODULATION CIRCUIT AND METHOD THEREOF

FIELD OF THE INVENTION

Embodiments of the present disclosure relate to systems of backlight modulation circuits that are used in liquid crystal displays (LCDs), and more particularly to systems and methods of a backlight modulation circuit with rough and fine modulation functions.

GENERAL BACKGROUND

Because LCDs have the advantages of portability, low power consumption, and low radiation, they have been widely used in various portable information products such as notebooks, personal digital assistants (PDAs), video cameras, etc.

A conventional LCD typically includes a liquid crystal panel, a backlight module with a plurality of light sources for illuminating the LCD panel, and a backlight modulation circuit for modulating illumination provided by the backlight module.

Referring to FIG. 6, one embodiment of an analog method for modulating illumination provided by a backlight module of an LCD is shown. In the method of FIG. 6, as a voltage level for a driving voltage increases, the illumination provided by the backlight module also increases. Likewise, as a voltage level for a driving voltage decreases, the illumination provided by the backlight module also decreases. The one-to-one correspondence between the voltage and the illumination under the control of the backlight modulation circuit may modulate the backlight module in a range of 70% to 100% of a maximum illumination for the backlight module.

In a digital method for modulating illumination provided by a backlight module, pulse width modulation (PWM) and pulse frequency modulation (PFM), may be used. FIG. 7 illustrates one embodiment of a PWM method for modulating illumination provided by a backlight module. In the PWM method, a duty ratio of a pulse voltage signal is changed in order to modulate the illumination provided by the backlight module. When the duty ratio increases, the illumination provided by the backlight module also increases. Similarly, when the duty ratio decreases, the illumination provided by the backlight module also decreases. Accordingly, the illumination provided by the backlight module can be modulated via changing the duty ratio of the pulse voltage signal. Using the PWM method, the illumination provided by the backlight module can be modulated in a range from 30% to 100% of a maximum illumination for the backlight module.

One drawback of the above-described analog and digital PWM methods is that they can only modulate the illumination provided by the backlight module either in a large and imprecise range or in a small and precise range. However, if an LCD needs to be modulated in a large and precise range, then many modulation commands and signals may need to be analyzed. Accordingly, modulating the many commands and signals wastes valuable processor cycles and consumes additional energy.

It is desired to provide a new backlight modulation circuit and a method for modulating illumination of a light source which can overcome the above-described deficiencies.

SUMMARY

In one aspect, a backlight modulation circuit comprises: an illumination controlling signal generating circuit configured for receiving a modulation signal and generating an illumination controlling signal according to the modulation signal; an illumination control signal separating circuit configured for separating the illumination controlling signal into a first modulation signal and a second modulation signal; and an illumination modulation circuit configured for modulating illumination of a backlight module according to the first and second modulation signals.

In another aspect, the aforementioned needs are satisfied by a method for modulating illumination of a light source, the method comprising: receiving an external modulation signal; generating an illumination controlling signal according to the external modulation signal; separating the illumination controlling signal into a first modulation signal and a second modulation signal; and modulating an illumination of the light source according to the first and second modulation signals.

Other novel features and advantages of the backlight modulation circuit and related method will become more apparent from the following detailed description when taken in conjunction with the accompanying drawings.

DETAILED DESCRIPTION OF CERTAIN INVENTIVE EMBODIMENTS

Reference will now be made to the drawings to describe various inventive embodiments of the present disclosure in detail, wherein like numerals refer to like elements throughout.

As used herein, the term, "fine modulation signal" refers to a modulation signal having a varied pulse time period and a constant amplitude in the varied pulse period. As used herein, the term, "rough modulation signal" refers to a modulation signal with a constant pulse time period and a varied amplitude in the constant pulse period.

Figure 1:
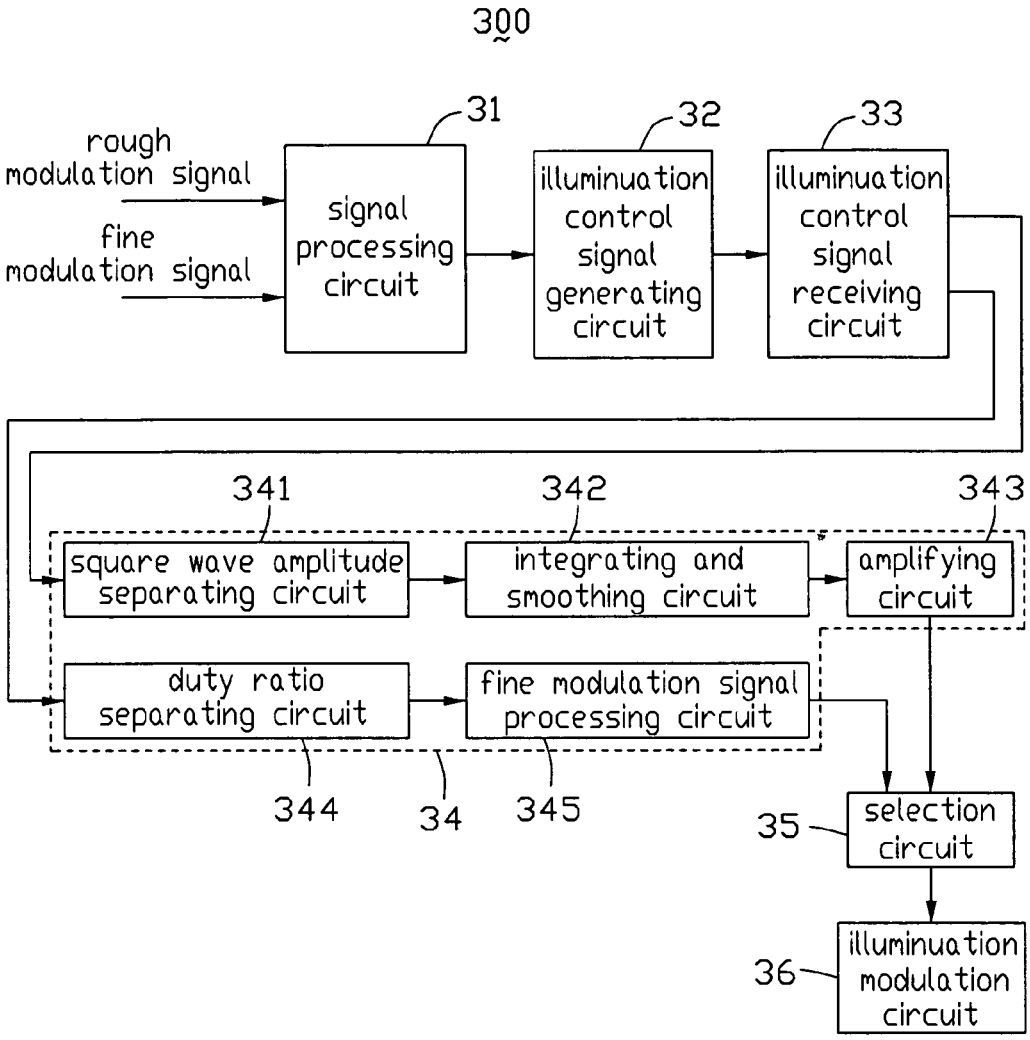
FIG. 1 is a block diagram of one embodiment of a backlight modulation circuit which may be employed in an LCD according to the present disclosure.

FIG. 1 shows a block diagram of one embodiment of a backlight modulation circuit 300 of the present disclosure. The backlight modulation circuit 300 may be used in an LCD (not shown) to illuminate the LCD. In one embodiment, the LCD may comprise a liquid crystal panel and a backlight module having at least one light source. The at least one light source may be a cold cathode fluorescent lamp (CCFL) or a light emitting diode (LED). The backlight modulation circuit 300 comprises a signal processing circuit 31, an illumination control signal generating circuit 32, an illumination control signal receiving circuit 33, an illumination control signal separating circuit 34, a selection circuit 35, and an illumination modulation circuit 36. The illumination control signal separating circuit 34 further includes a square wave amplitude separating circuit 341, an integrating and smoothing circuit 342, an amplifying circuit 343, a duty ratio separating circuit 344, and a fine modulation signal processing circuit 345.

It may be understood that the signal processing circuit 31 may receive one or more modulation signals from an external device electrically coupled to the signal processing circuit 31. The modulation signal may include rough and/or fine modulating signal(s) to be processed by the signal processing circuit 31. It is to be further appreciated that a signal may comprise a control bit and a data bit. The control bit may comprise a binary number (i.e. 1 or 0), while the data bit may comprise one or more binary numbers comprising a modulation signal.

After the signal processing unit 31 and the illumination control generating circuit 32 process the modulation signal into an illumination control signal, the illumination control signal is transmitted to the illumination control signal separating circuit 34 via the illumination control signal receiving circuit 33. In the illumination control signal separating circuit 34, a rough modulation signal is separated from the illumination control signal using the square wave amplitude separating circuit 341, the integrating and smoothing circuit 342, and the amplifying circuit 343. Furthermore, a fine modulation signal is separated from the illumination control signal using the duty ratio separating circuit 344 and the fine modulation signal processing circuit 345. The selection circuit 35 selects one of the rough and fine modulation signals, altered by the illumination control separating circuit 34, and sends the selected signal to the illumination modulation circuit 36. The illumination modulation circuit 36 modulates illumination of the light source according to the received fine or rough modulation signal. Further details of receiving and processing a modulation signal will be explained below in more detail with respect to the flowchart of FIG. 2.

Figure 2:
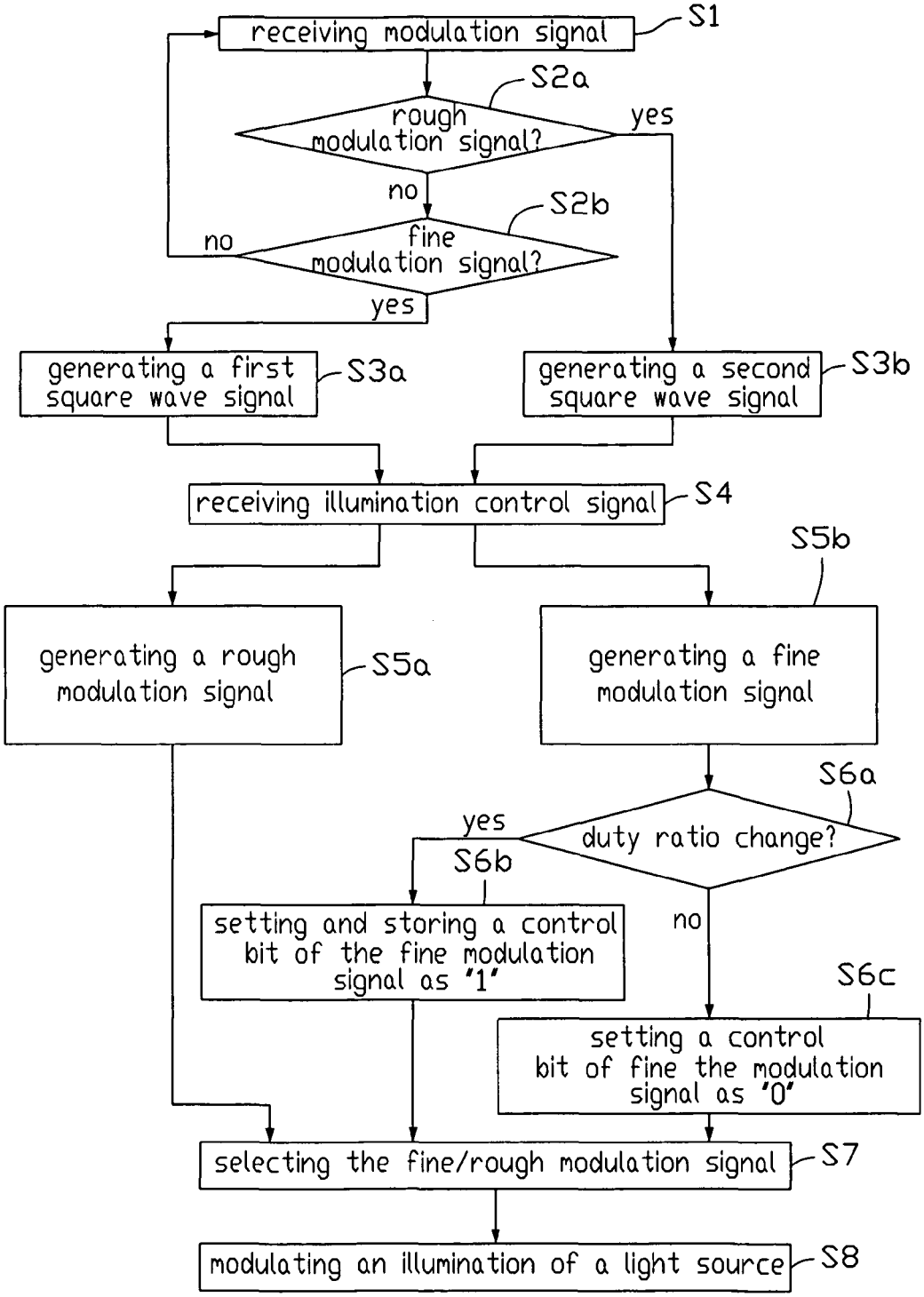
FIG. 2 is a flowchart of one embodiment of a method for modulating illumination of a backlight module of an LCD using the backlight modulation circuit of FIG. 1.

FIG. 2 is a flowchart of one embodiment of a method for modulating illumination of a backlight module of an LCD using the backlight modulation circuit of FIG. 1. Depending on the embodiment, the flowchart of FIG. 2 may comprise fewer or more steps and the steps may be performed in a different order than illustrated.

In step S1, the signal processing circuit 31 receives a modulation signal from an external device, such as a keyboard, or a remote controller, for example.

In step S2, a signal type of the modulation signal is determined by the signal processing circuit 31. Step S2 can be divided into sub-step S2*a* and sub-step S2*b*.

In step S2*a*, the signal processing circuit 31 determines whether the signal is a rough modulation signal. If the determination is "yes", then the method proceeds to step S3*b*, which is described below. If the determination is "no", then the method proceeds to step S2*b*.

In step S2*b*, the signal processing circuit 31 determines whether the signal is a fine modulation signal. If the determination is "yes", then the method proceeds to step S3*a*, which is described below. If the determination is "no", then the method proceeds back to step S1.

Figure 3:
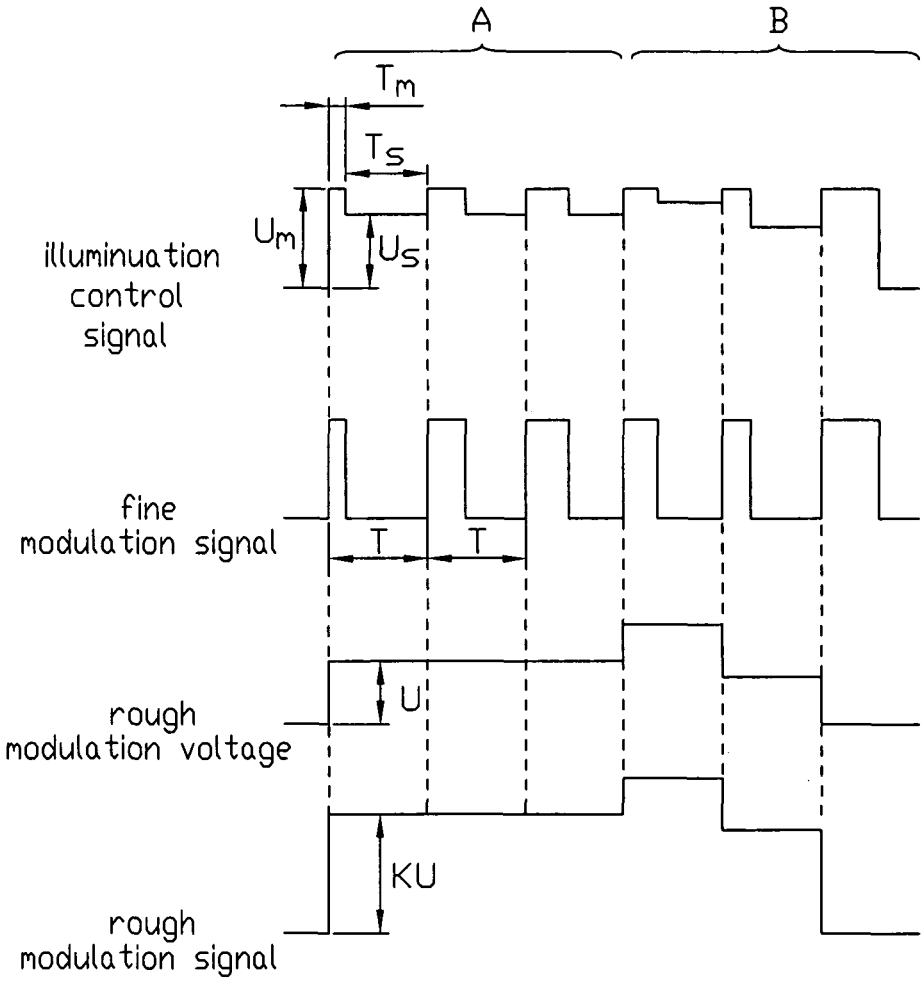
FIG. 3 shows one embodiment of waveforms of voltage signals of the backlight modulation circuit of FIG. 1.

In step S3, the illumination control signal generating circuit 32 generates an illumination control signal according to the modulation signal. FIG. 3 shows one embodiment of a square waveform of an illumination control signal generated by the illumination control signal generating unit 32. In FIG. 3, the square waveform is divided into a plurality of time periods T, with each time period T being divided into a primary time period Tm with an amplitude Um, and a secondary time period Ts with an amplitude Us. Step S3 can be divided into sub-step S3*a* and sub-step S3*b*.

In sub-step S3*a*, the illumination control signal generating circuit 32 generates a first square wave signal which is shown as part A of the illumination control signal in FIG. 3. In each of the time periods T, the primary amplitude Um of the first square wave signal is constant, but a pulse time period Tm of the first square wave signal may be varied.

In sub-step S3*b*, the illumination control signal generating circuit 32 generates a second square wave signal which is shown as the part B of the illumination control signal in FIG. 3. In each of the periods T, the secondary amplitude Us of the second square wave signal may be varied, but a pulse time period Ts of the second square wave signal is constant. Accordingly, the first square wave signal "A" and the second square wave signal "B" comprise the illumination control signal.

After steps S3*a* and S3*b* are carried out, the method proceeds to step S4. In step S4, the illumination control signal receiving circuit 33 receives the illumination control signal, and sends the illumination control signal to the illumination control signal separating circuit 34.

In step S5, the illumination control signal separating circuit 34 separates the illumination control signal into a rough modulation signal and a fine modulation signal. Step S5 is divided into sub-step S5*a* and sub-step S5*b*.

In sub-step S5*a*, the rough modulation signal is separated from the illumination control signal by the square wave amplitude separating circuit 341, the integrating and smoothing circuit 342, and the amplifying circuit 343. In one embodiment, the rough modulation signal may be expressed according to the following equation:

$$U=(Um*Tm+Us*Ts)/T$$

where Tm represents a time period of the primary amplitude Um in a time period T, Ts represents a time period of the secondary amplitude Us in a time period T, and U represents a voltage value of the rough modulation signal.

The voltage value U is amplified K times to obtain a rough modulation signal KU, which is shown as the fourth curve in FIG. 3. Then the method proceeds to step S7. It may be understood that a value of K may depend on varying conditions, such as the voltage value U and operation of the LCD 300, for example.

In sub-step S5*b*, the fine modulation signal is separated from the illumination control signal via the duty ratio separating circuit 344. In one embodiment, the fine modulation signal may correspond to the primary amplitude portion Tm of the illumination control signal. Then the method proceeds to step S6.

In step S6, the fine modulation signal is processed by the fine modulation signal processing circuit 345. Step S6 is divided into sub-step S6*a*, sub-step S6*b*, and sub-step S6*c*.

In sub-step S6*a*, the fine modulation signal processing circuit 345 determines whether a duty ratio of the fine modulation signal has been changed. If the answer is "yes", the method proceeds to sub-step S6*b*. If the answer is "no", the method proceeds to sub-step S6*c*.

In sub-step S6*b*, a control bit of the fine modulation signal is set as "1". Then the method proceeds to step S7.

In sub-step S6*c*, a control bit of the fine modulation signal is set as "0". Then the method proceeds to step S7.

In step S7, the selection circuit 35 selects either one of the rough modulation signal or the fine modulation signal as a final modulation signal. In one example, if the control bit of the fine modulation signal is "1", then the selection circuit 35 selects the fine modulation signal and sends it to the illumination modulation circuit 36. In another example, if the control bit of the fine modulation signal is "0", then the selection circuit 35 selects the rough modulation signal and sends it to the illumination modulation circuit 36.

In step S8, illumination of a light source is modulated by the illumination modulation circuit 36 according to the received modulation signal in step S7. In one example, if the illumination modulation circuit 36 receives the rough modulation signal, then the illumination modulation circuit 36 may rapidly change a driving voltage of the light source to vary in a large range. Thus, illumination of the light source can be modulated in a large range within a short time period. In another example, if the illumination modulation circuit 36 receives the rough modulation signal, then the illumination modulation circuit 36 may slowly change a driving voltage of the light source to vary in a small range. Thus, the illumination of the light source can be precisely modulated in a small range.

The backlight modulation circuit 300 is able to process both a rough modulation signal and a fine modulation signal in the same time period. Thus illumination of the backlight module can be modulated precisely once in a short time period. This provides convenience and saves operational time.

Figure 4:
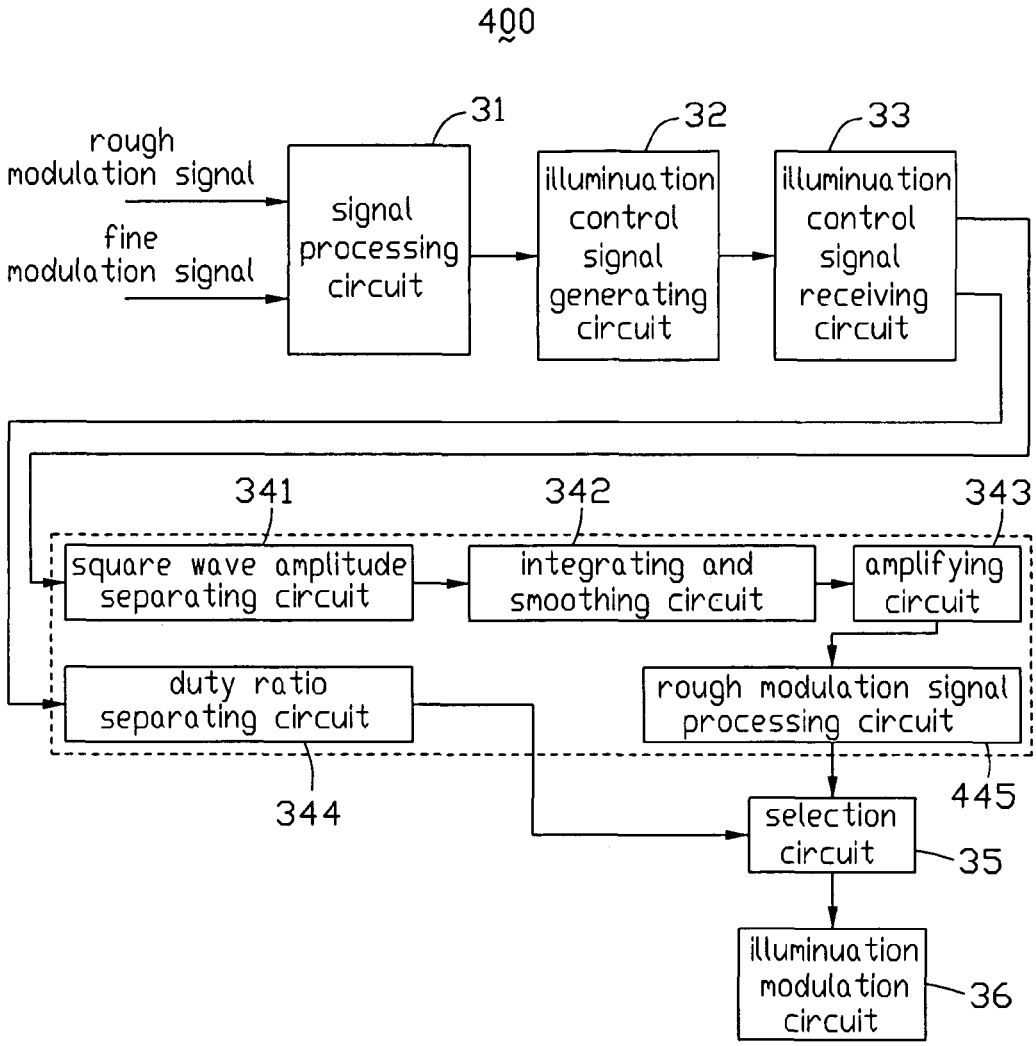
FIG. 4 is a block diagram of another embodiment of a backlight modulation circuit which is typically employed in an LCD according to the present disclosure.

FIG. 4 is a block diagram of one embodiment of a backlight modulation circuit 400 which is typically employed in an LCD according to another embodiment of the present disclosure. The backlight modulation circuit 400 may be substantially similar to the backlight modulation circuit 300 as shown in FIG. 1. However, an illumination control signal separating circuit 37 of the backlight modulation circuit 400 includes the square wave amplitude separating circuit 341, the integrating and smoothing circuit 342, the amplifying circuit 343, the duty ratio separating circuit 344, and a rough modulation signal processing circuit 445.

After processing a rough and a fine modulation signal by the signal processing circuit 31, the illumination control signal generating unit 32, and the illumination control signal receiving unit 33, an illumination control signal is transmitted to the illumination control signal separating circuit 37. In the illumination control signal separating circuit 37, a rough modulation signal is separated from the illumination control signal by the square wave amplitude separating circuit 341, the integrating and smoothing circuit 342, the amplifying circuit 343, and the rough modulation signal processing circuit 445. A fine modulation signal is separated from the illumination control signals via the duty ratio separating circuit 344. Then the selection circuit 35 selects one of the rough and fine modulation signals which is changed, and sends the fine/rough modulation signal to the illumination modulation circuit 36, and sends the selected one of the fine and rough modulation signals to the illumination modulation circuit 36. Then the illumination modulation circuit 36 modulates illumination of the light source according to the fine/rough modulation signal.

Figure 5:
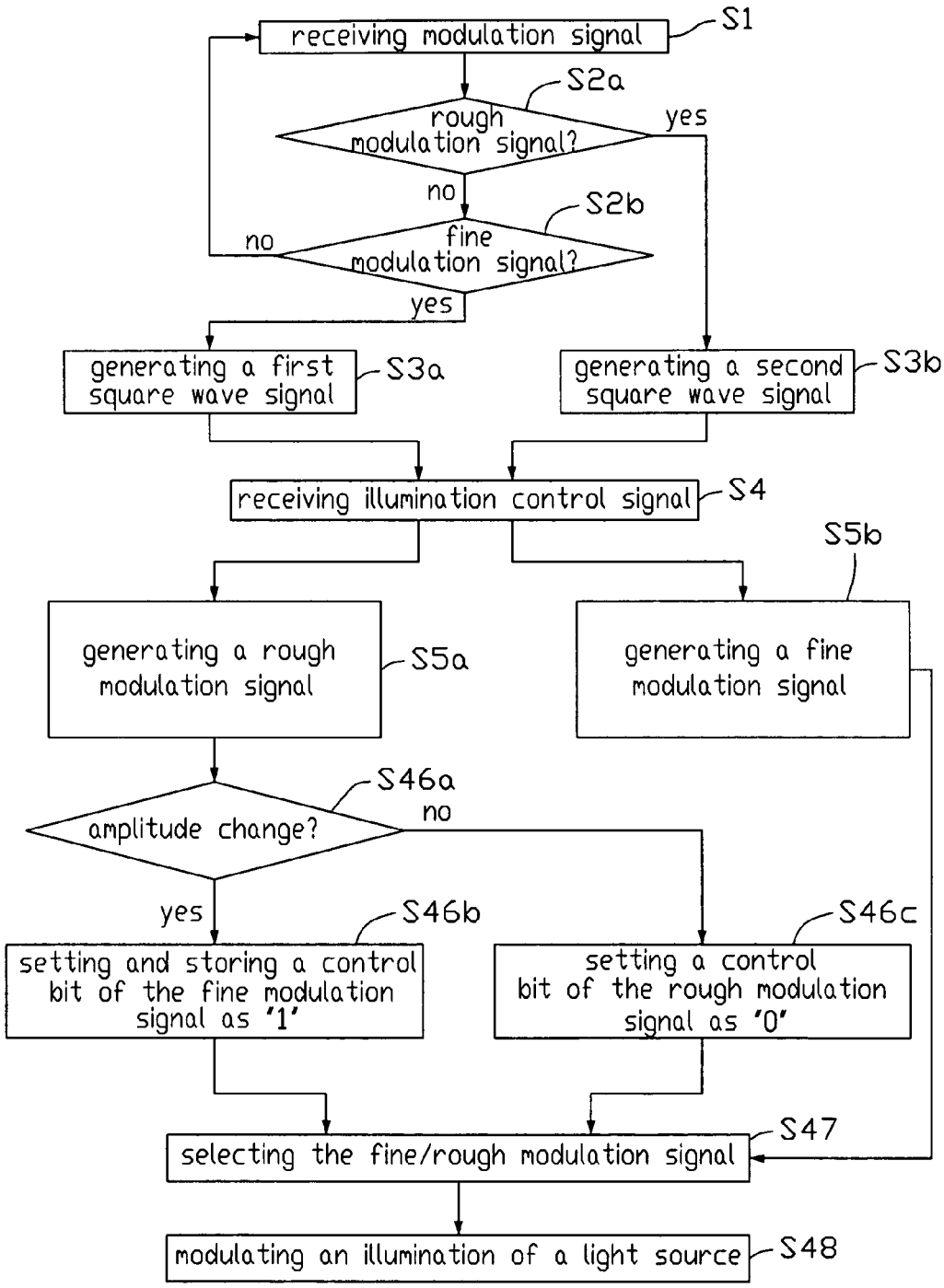
FIG. 5 is a flowchart of one embodiment of a method for modulating illumination of a backlight module of an LCD using the backlight modulation circuit of FIG. 4.
Figure 6:
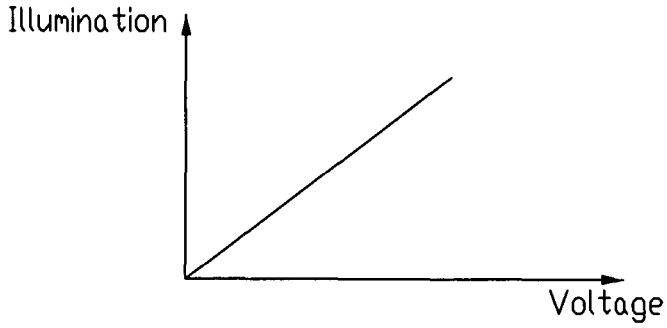
FIG. 6 (RELATED ART)
FIG. 6 shows one embodiment of a first conventional method for modulating illumination of a backlight module of an LCD.
Figure 7:
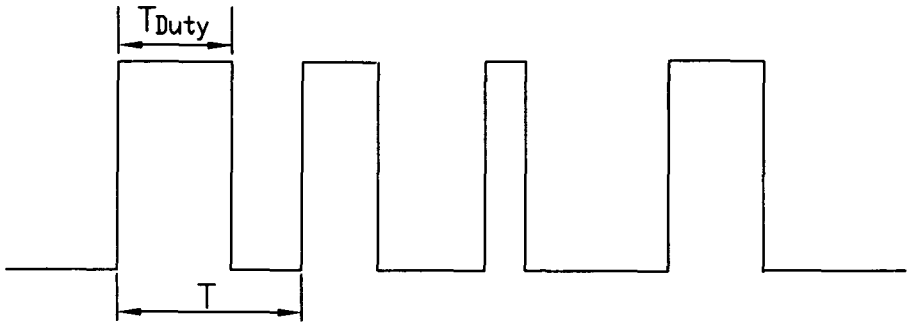
FIG. 7 (RELATED ART)
FIG. 7 shows one embodiment of a second conventional method for modulating illumination of a backlight module of an LCD.

FIG. 5 is a flowchart of one embodiment of a method for modulating illumination of a backlight module of an LCD using the backlight modulation circuit of FIG. 4. Depending on the embodiment, the flowchart of FIG. 5 may comprise fewer of more steps and the steps may be performed in a different order than illustrated.

In the flowchart of FIG. 5, step S1 through step S5*a* and S5*b* may be substantially similar to step S1 through step S5*a* and S5*b* of the flowchart of FIG. 2.

In step S46, the fine modulation signal is processed by the rough modulation signal processing circuit 445. Step S46 is divided into sub-step S46*a*, sub-step S46*b*, and sub-step S46*c*.

In sub-step S46*a*, the rough modulation signal processing circuit 445 determines whether an amplitude of the rough modulation signal is changed in a predetermined time period. If the answer is "yes", the method proceeds to sub-step S46*b*. If the answer is "no", the method proceeds to sub-step S46*c*.

In sub-step S46*b*, a control bit of the rough modulation signal is set as "1". Then the method proceeds to step S47.

In sub-step S46*c*, a control bit of the rough modulation signal is set as "0". Then the method proceeds to step S47.

In step S47, the selection circuit 35 selects either one of the rough modulation signal or the fine modulation signal as a final modulation signal. In one example, if the control bit of the rough modulation signal is "1", then the selection circuit 35 selects the rough modulation signal and sends it to the illumination modulation circuit 36. In another example, if the control bit of the rough modulation signal is "0", then the selection circuit 35 selects the fine modulation signal and sends it to the illumination modulation circuit 36.

In step S48, illumination of a light source is modulated by the illumination modulation circuit 36 according to the final modulation signal. If the illumination modulation circuit 36 receives the rough modulation signal, then the illumination modulation circuit 36 controls the driving circuit to rapidly change a driving voltage of the light source in a large range; thereby, illumination of the light source can be modulated in a large range within a short time. If the illumination modulation circuit 36 receives the fine modulation signal, then the illumination modulation circuit 36 controls the driving circuit to change a driving voltage of the light source slowly in a small range; thereby, the illumination of the light source can be modulated precisely in a small range.

It is to be understood, however, that even though numerous characteristics and advantages of certain inventive embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A backlight modulation circuit comprising:

an illumination control signal generating circuit configured for receiving a modulation signal and generating an illumination control signal according to the modulation signal;

an illumination control signal separating circuit configured for separating the illumination control signal into a first modulation signal and a second modulation signal; and an illumination modulation circuit configured for modulating illumination of a backlight module according to the first and second modulation signals;

wherein the illumination control signal separating circuit comprises a square wave amplitude separating circuit, an integrating and smoothing circuit, an amplifying circuit, a duty ratio separating circuit, and a fine modulation signal processing circuit, wherein the first modulation signal is separated by the square wave amplitude separating circuit, the integrating and smoothing circuit, and the amplifying circuit, and wherein the second modulation signal is separated by the duty ratio separating circuit and the fine modulation signal processing circuit.

2. The backlight modulation circuit of claim 1, wherein the first modulation signal is a rough modulation signal, and the second modulation signal is a fine modulation signal.

3. A backlight modulation circuit comprising:

an illumination control signal generating circuit configured for receiving a modulation signal and generating an illumination control signal according to the modulation signal;

an illumination control signal separating circuit configured for separating the illumination control signal into a first modulation signal and a second modulation signal; and an illumination modulation circuit configured for modulating illumination of a backlight module according to the first and second modulation signals;

wherein the illumination control signal separating circuit comprises a square wave amplitude separating circuit, an integrating and smoothing circuit, an amplifying circuit, a rough modulation signal processing circuit, and a duty ratio separating circuit, and wherein the first modulation signal is separated by the square wave amplitude separating circuit, the integrating and smoothing circuit, the amplifying circuit, and the rough modulation signal processing circuit, and wherein the second modulation signal is separated via the duty ratio separating circuit.

4. The backlight modulation circuit of claim 3, further comprising a selection circuit, the selection circuit electrically positioned between the illumination control signal separating circuit and the illumination modulation circuit for selecting and sending one of the first and second modulation signals to the illumination modulation circuit.

5. The backlight modulation circuit of claim 4, further comprising an illumination control signal receiving circuit electrically positioned between the illumination control signal generating circuit and the illumination control signal separating circuit, illumination control signal receiving circuit configured for receiving the illumination controlling control signal and sending the illumination control signal to the illumination control signal separating circuit.

6. The backlight modulation circuit of claim 4, further comprising a signal processing circuit configured for analyzing a type of the modulation signal, wherein the type is one of a rough modulation signal or a fine modulation signal, and wherein the illumination control signal generating circuit generates an illumination controlling control signal according to the type of modulation signal.

7. A method for modulating illumination of a light source, the method comprising:

receiving an external modulation signal;

generating an illumination control signal according to the external modulation signal;

separating the illumination control signal into a first modulation signal and a second modulation signal; and modulating an illumination of the light source according to the first and second modulation signals;

wherein the illumination control signal comprises a plurality of time periods T, wherein each time period T comprises a primary time period Tm with an amplitude Um, and a secondary time period Ts with an amplitude Us;

wherein the first modulation signal is executed by a square wave amplitude separating circuit, an integrating and smoothing circuit, and an amplifying circuit.

8. The method of claim 7, further comprising analyzing a type of modulation signal before generating the illumination control signal.

9. The method of claim 8, wherein the first modulation signal is a rough modulation signal, and the second modulation signal is a fine modulation signal.

10. The method of claim 8, wherein analyzing the type of modulation signal comprises analyzing whether the modulation signal is a rough modulation signal or a fine modulation signal.

11. The method of claim 10, further comprising generating a first square wave signal having a varied pulse time period and a constant amplitude in the varied pulse period upon the condition that the modulation signal is a fine modulation signal.

12. The method of claim 10, further comprising generating a second square wave signal with a constant pulse time period and a varied amplitude in the constant pulse period upon the condition that the modulation signal is a rough modulation signal.

13. The method of claim 8, wherein the rough modulation signal is in the form of the equation:

$U=(Um*Tm+Us*Ts)/T$ wherein the output U is a voltage value of the rough modulation signal.

14. The method of claim 7, further comprising selecting one of the first and second modulation signals and modulating the illumination of the light source according to the selected one of the first and second modulation signals.

15. The method of claim 7, wherein the second modulation signal is executed by a duty ratio separating circuit, and a fine modulation signal processing circuit.

16. The method of claim 7, wherein the second modulation signal is executed by a square wave amplitude separating circuit, an integrating and smoothing circuit, an amplifying circuit, and a rough modulation signal processing circuit.

17. The method of claim 7, wherein the second modulation signal is executed by a duty ratio separating circuit.

* * * * *